US008702207B2

(12) United States Patent
Scheffelin et al.

(10) Patent No.: US 8,702,207 B2
(45) Date of Patent: Apr. 22, 2014

(54) FLUID-EJECTION PRINTHEAD HAVING MIXING BARRIER

(75) Inventors: Joseph E. Scheffelin, Poway, CA (US); Peter R. Stokes, Monroe, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 6 days.

(21) Appl. No.: 13/259,205

(22) PCT Filed: May 17, 2009

(86) PCT No.: PCT/US2009/044280

§ 371 (c)(1), (2), (4) Date: Sep. 23, 2011

(87) PCT Pub. No.: WO2010/134901

PCT Pub. Date: Nov. 25, 2010

(65) Prior Publication Data

US 2012/0026247 A1 Feb. 2, 2012

(51) Int. Cl.
*B41J 2/14* (2006.01)

(52) U.S. Cl.
USPC ..... 347/47

(58) Field of Classification Search
USPC ..... 347/20, 40, 47
See application file for complete search history.

(56) References Cited

U.S. PATENT DOCUMENTS

| | | | | |
|---|---|---|---|---|
| 5,905,513 | A * | 5/1999 | Brandon et al. | 347/33 |
| 6,270,191 | B1 * | 8/2001 | Morikoshi et al. | 347/44 |
| 6,398,343 | B2 * | 6/2002 | Silverbrook | 347/40 |
| 6,578,950 | B2 | 6/2003 | Matsumoto et al. | |
| 6,820,963 | B2 * | 11/2004 | Stauffer et al. | 347/43 |
| 7,172,266 | B2 * | 2/2007 | Foote et al. | 347/49 |
| 7,427,123 | B2 | 9/2008 | Foote et al. | |
| 7,452,055 | B2 | 11/2008 | Hibbard et al. | |
| 2004/0145626 | A1 | 7/2004 | Stauffer et al. | |
| 2005/0157065 | A1 | 7/2005 | Silverbrook et al. | |
| 2006/0152545 | A1 | 7/2006 | Silverbrook et al. | |
| 2007/0091143 | A1 | 4/2007 | Foote et al. | |
| 2007/0126797 | A1 | 6/2007 | Hibbard et al. | |
| 2007/0206050 | A1 | 9/2007 | Morgan et al. | |
| 2008/0150988 | A1 | 6/2008 | Jang | |
| 2008/0252688 | A1 | 10/2008 | Hibbard et al. | |

FOREIGN PATENT DOCUMENTS

| | | |
|---|---|---|
| JP | 10095114 | 4/1998 |
| JP | 2005-096340 | 4/2005 |
| JP | 2007-190709 | 8/2007 |
| JP | 2009012374 | 1/2009 |
| WO | WO-2006128482 A1 | 12/2006 |

OTHER PUBLICATIONS

Supplementary European Search Report for Application No. EP09845017.4. Report issued Sep. 7, 2012.

* cited by examiner

*Primary Examiner* — Alessandro Amari
*Assistant Examiner* — Michael Konczal

(57) ABSTRACT

A fluid-ejection printhead die includes first fluid-ejection nozzles, second fluid-ejection nozzles, and a mixing barrier. The first fluid-ejection nozzles eject fluid of a first type, and are organized over a first row and a second row non-collinear to the first row. The second fluid-ejection nozzles eject fluid of a second type different than the first type, and are organized over a third row and a fourth row non-collinear to the third row. The fourth row is at least substantially collinear to the first row. The mixing barrier is at least substantially between the first row of the first fluid-ejection nozzles and the fourth row of the second fluid-ejection nozzles.

19 Claims, 4 Drawing Sheets

FLUID-EJECTION PRINTHEAD HAVING MIXING BARRIER

BACKGROUND

One type of inkjet-printing device, which is more generally referred to as a fluid-ejection device, is a page-wide array inkjet-printing device. In this type of inkjet-printing device, a number of inkjet printheads, which are more generally referred to as fluid-ejection printheads, are organized as an array at least substantially perpendicular to the direction of movement of media sheets through the device. The array is a page-wide array in that the printheads extend from one side or edge of the media sheets to the other side or edge of the media sheets. As such, the array is typically stationary during printing; as media sheets are moved past the array, the printheads eject ink onto the sheets.

A page-wide array inkjet-printing device thus contrasts with another type of inkjet-printing device known as a scanning printhead inkjet-printing device. In the latter type of inkjet-printing device, a scanning inkjet printhead moves, or scans, along a section, or swath, of a media sheet from one side to the other side of the sheet, ejecting ink along this media sheet section as it moves over the section. When printing on the current swath has finished, the media sheet is advanced slightly so that a new swath is incident to the printhead, and the printhead scans over the new swath. This process is repeated until ink has been printed on the media sheet as desired.

In general, page-wide array inkjet-printing devices are typically faster than scanning printhead inkjet-printing devices, in that a complete media sheet can have ink printed thereon in a desired manner more quickly using the former type of inkjet-printing device as compared to the latter type of inkjet-printing device. However, all inkjet-printing devices and other types of fluid-ejection devices are usually susceptible to buildup of fluid and debris around and on fluid-ejection nozzles through which ink is actually ejected. Therefore, a wiping operation may be periodically performed to wipe fluid buildup and debris from the nozzles.

DETAILED DESCRIPTION OF THE DRAWINGS

Overview of Problem and Solution

Figure 1:
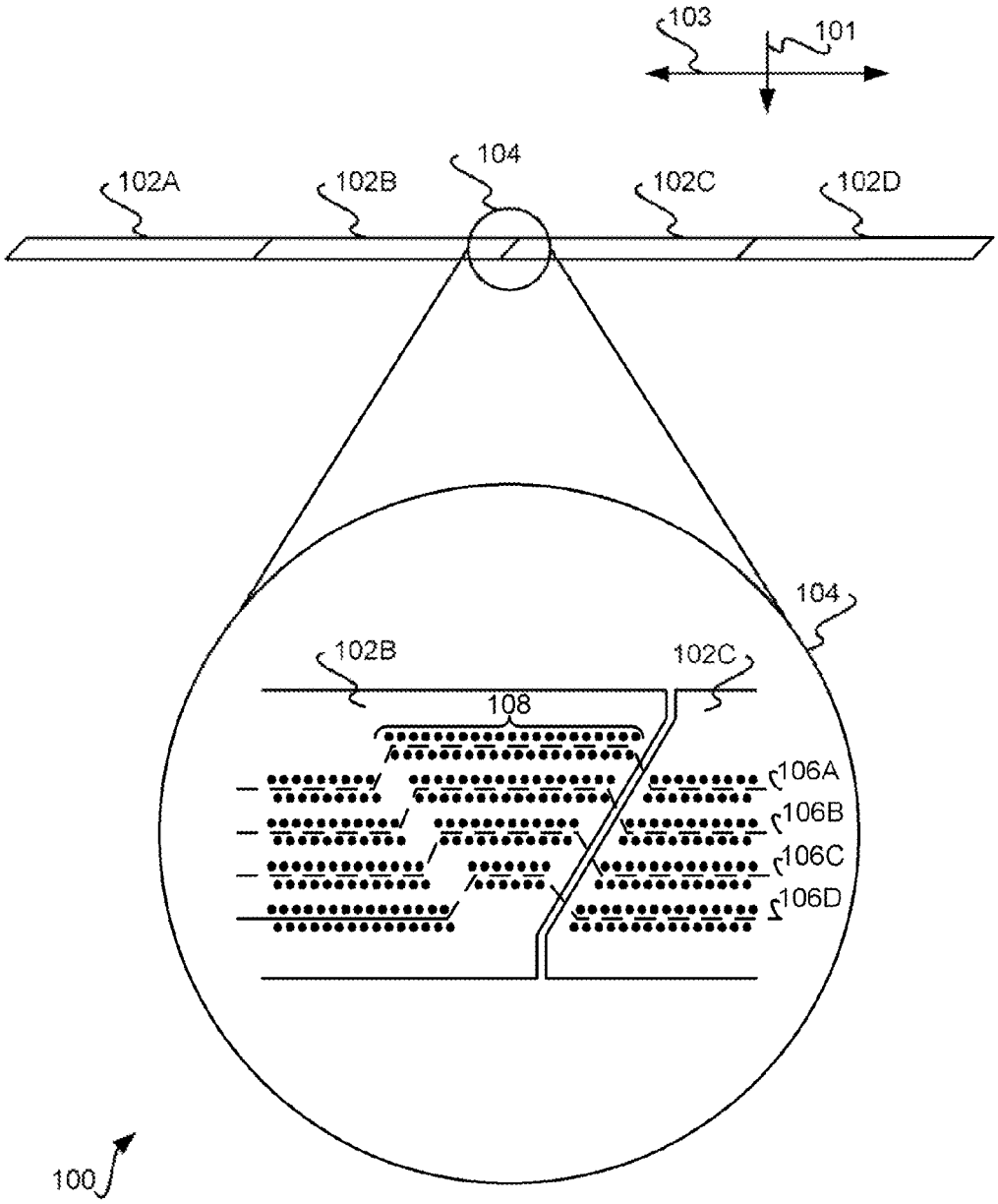
FIG. 1 is a diagram of a representative fluid-ejection device having fluid-ejection printhead dies, according to an embodiment of the present disclosure.

As has been described above in the background, a page-wide array fluid-ejection device includes an array of fluid-ejection printheads organized as an array along an axis at least substantially perpendicular to the direction of media movement through the device. Each fluid-ejection printhead includes a fluid-ejection printhead die that has the fluid-ejection nozzles through which fluid is actually ejected. To optimize fluid-ejection quality, such as printing quality, some fluid-ejection nozzles ejecting a given type of fluid, such as a given color of ink, are offset from the other fluid-ejection nozzles ejecting this same type of fluid, towards or at the boundaries of the fluid-ejection printhead dies. This arrangement compensates for any misalignment between the fluid-ejection nozzles of adjacent fluid-ejection printhead dies, ensuring optimal fluid-ejection-quality.

The inventors have innovatively recognized that offsetting some of the fluid-ejection nozzles ejecting a given type of fluid from the other fluid-ejection nozzles ejecting this same type of fluid, towards or at the boundaries of the fluid-ejection printhead dies, can be problematic during servicing of the nozzles. One type of fluid-ejection nozzle servicing is known as wiping. As has been described above in the background, a wiping operation may be periodically performed to wipe fluid buildup and debris from the fluid-ejection nozzles. For example, a mechanical wiper may be moved relative to the fluid-ejection nozzles back and forth along an axis perpendicular to the direction of media movement through the fluid-ejection device.

The problems that the inventors have innovatively recognized is that offsetting some of the fluid-ejection nozzles ejecting a given type of fluid from the other fluid-ejection nozzles ejecting this same type of fluid, towards or at the boundaries of the fluid-ejection printhead dies, can cause mixing of fluids of different types and impair fluid-ejection quality. For example, the offset fluid-ejection nozzles ejecting a first type of fluid may be collinear with the non-offset fluid-ejection nozzles ejecting a second type of fluid along the axis perpendicular to the direction of media movement through the fluid-ejection device. As such, wiping the fluid-ejection nozzles back and forth along this axis can cause the first and the second types of fluid to mix.

The result can thus be that the offset fluid-ejection nozzles ejecting the first type of fluid become contaminated with the second type of fluid, and the non-offset nozzles ejecting the second type of fluid become contaminated with the first type of fluid, impairing fluid-ejection quality, such as printing quality. Upon innovatively recognizing this problem with offsetting some of the fluid-ejection nozzles, the inventors have developed a novel solution that at least substantially overcomes this issue. In particular, the inventors have introduced mixing barriers on the fluid-ejection printhead dies that at least substantially prevent fluids of different types from mixing with one another. As such, offset fluid-ejection nozzles ejecting a first type of fluid are not contaminated with a second type of fluid ejected by collinear non-offset nozzles, and vice-versa.

Representative Fluid-ejection Device Showing Problem Solved by Inventors

FIG. 1 shows a fluid-ejection device 100 in relation to which the problem recognized by the inventors is described in more detail, according to an embodiment of the disclosure. The fluid-ejection device 100 is exemplarily depicted in FIG. 1 as including four fluid-ejection printhead dies 102A, 102B, 102C, and 102D, collectively referred to as the fluid-ejection printhead dies 102. The fluid-ejection printhead dies 102 are organized short edge-to-short edge along an axis 103 that is perpendicular to the direction of media movement 101 through the fluid-ejection device 100. A blown-up or zoomed-in region 104 exemplarily depicts the fluid-ejection nozzles (as solid circles) of the printhead dies 102B and 102C towards the boundary between the dies 102B and 102C.

The fluid-ejection nozzles of the fluid-ejection printhead dies 102B and 102C are organized to either side of four dotted lines 106A, 106B, 106C, and 106D, collectively referred to as the dotted lines 106. The fluid-ejection nozzles to either side of the dotted line 106A ejects fluid of a first type, such as cyan-colored ink; and the nozzles to either side of the dotted line 1068 ejects fluid of a second type, such as magenta-colored ink. The nozzles to either side of the dotted line 106C ejects fluid of a third type, such as yellow-colored ink; and the nozzles to either side of the dotted line 106D ejects fluid of a fourth type, such as black-colored ink.

The fluid-ejection nozzles within a region, 108 are offset from the other fluid-ejection nozzles. For example, the fluid-ejection nozzles to either side of the dotted line 106B within the region 108 are offset from the fluid-ejection nozzles to either side of the dotted line 1068 that are not within the region 108. More specifically, the fluid-ejection nozzles to either side of the dotted line 106B within the region 108 are at least substantially collinear along the axis 103 with the fluid-ejection nozzles to either side of the dotted line 106A that are not within the region 108. The problem solved by the inventors is exemplarily described in relation to the non-offset fluid-ejection nozzles to either side of the dotted line 106A that are not within the region 108, and to the offset fluid-ejection nozzles to either side of the dotted line 106B that are within the region 108.

During a wiping operation along the axis 103, the first type of fluid ejected by the non-offset fluid-ejection nozzles to either side of the dotted line 106A that are not within the region 108 may mix with the second type of fluid ejected by the offset fluid-ejection nozzles to either side of the dotted line 106B within the region 108, and vice-versa. Therefore, the non-offset fluid-ejection nozzles to either side of the dotted line 106A that are not within the region 108 may become contaminated with the second type of fluid. Likewise, the offset fluid-ejection nozzles to either side of the dotted line 106B that are within the region 108 may become contaminated with the first type of fluid.

Such cross contamination of the fluid-ejection nozzles can impair printing quality. For example, the fluid-ejection nozzles to either side of the dotted line 106A may eject cyan ink, whereas the fluid-ejection nozzles to either side of the dotted line 106B may eject yellow ink. However, if the former fluid-ejection nozzles are contaminated with yellow ink, and the latter fluid-ejection nozzles are contaminated with cyan ink, then printing quality can suffer. In particular, the contaminated fluid-ejection nozzles to either side of the dotted line 106A may eject yellow-tinged cyan ink, and the contaminated fluid-ejection nozzles to either side of the dotted line 1066 may eject cyan-tinged yellow ink.

Solution to Problem

Figure 2:
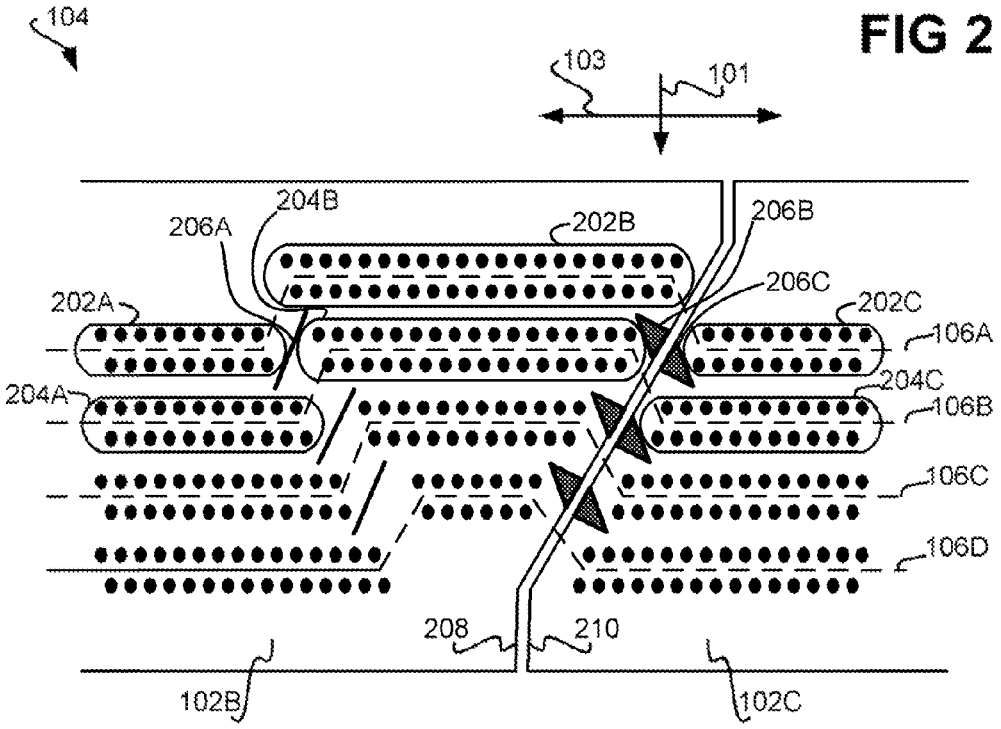
FIG. 2 is a diagram of a portion of a fluid-ejection device having mixing barriers on its fluid-ejection printhead dies, according to an embodiment of the present disclosure.

FIG. 2 shows the blown-up or zoomed-in region 104 of the fluid-ejection device 100 of FIG. 1 in detail, in relation to which the solution to the problem that has been described above is described in detail, according to an embodiment of the disclosure. The fluid-ejection nozzles of the fluid-ejection printhead dies 102B and 102C are depicted, organized to either side of the four dotted lines 106A, 1066, 106C, and 1060. The solution is exemplarily described in relation to the fluid-ejection nozzles to either side of the dotted lines 106A and 1068. However, the solution is equally appropriate in relation to the fluid-ejection nozzles to either side of the dotted lines 106C and 1060 as well.

As to the fluid-ejection printhead die 102B, the fluid-ejection nozzles 202A and 2026 are organized to either side of the dotted line 106A, and eject fluid of a first type. The fluid-ejection nozzles 202A are said to be organized over a first row, whereas the fluid-ejection nozzles 202B are said to be organized over a second row. The fluid-ejection nozzles 202B are therefore offset from and non-collinear to the fluid-ejection nozzles 202A; that is, the second row is non-collinear to the first row. The first row is longer than the second row, which is not necessarily explicitly depicted in FIG. 2, because just a portion of the fluid-ejection printhead die 102B is depicted in FIG. 2.

Still referring to the fluid-ejection printhead die 102B, the fluid-ejection nozzles 204A and 204B are organized to either side of the dotted line 1068, and eject fluid of a second type that is different than the first type. The fluid-ejection nozzles 204A are said to be organized over a third row, whereas the fluid-ejection nozzles 204B are said to be organized over a fourth row. The fluid-ejection nozzles 204B are therefore offset from and non-collinear to the fluid-ejection nozzles 204A; that is, the fourth row is non-collinear to the third row. Furthermore, the fluid-ejection nozzles 204B are at least substantially collinear with fluid-ejection nozzles 202A; that is, the fourth row is at least substantially collinear to the first row. The third row is longer than the fourth row, which is not necessarily explicitly depicted in FIG. 2, because just a portion of the fluid-ejection printhead die 102B is depicted in FIG. 2.

As to the fluid-ejection printhead die 102C, the fluid-ejection nozzles 202C of the fluid-ejection printhead die 102C are organized to either side of the dotted line 106A, and eject fluid of the first type. The fluid-ejection nozzles 202C are said to be organized over a fifth row that is at least substantially collinear with the first row of the fluid-ejection nozzles 202A of the fluid-ejection printhead die 102B. The fluid-ejection nozzles 202A and 202B of the fluid-ejection printhead die 102B and the fluid-ejection nozzles 202C of the fluid-ejection printhead die 102C are collectively referred to as the fluid-ejection nozzles 202.

Still referring to the fluid-ejection printhead die 102C, the fluid-ejection nozzles 204C of the fluid-ejection printhead die 102C are organized to either side of the dotted line 106B, and eject fluid of the second type. The fluid-ejection nozzles 204C are said to be organized over a fifth row that is at least substantially collinear with the second row of the fluid-ejection nozzles 204A of the fluid-ejection printhead die 102B. The fluid-ejection nozzles 204A and 204B of the fluid-ejection printhead die 102B and the fluid-ejection nozzles 204C of the fluid-ejection printhead die 102C are collectively referred to as the fluid-ejection nozzles 204.

To minimize cross-fluid contamination of the fluid-ejection nozzles 202A, 204B, and 202C during wiping of the fluid-ejection nozzles 202 and 204 along the axis 103, the inventors have novelly disposed mixing barriers 206A, 206B, and 206C, collectively referred to as the mixing barriers 206 on the surfaces of the fluid-ejection printhead dies 102B and 102C. The mixing barrier 206A is situated between the fluid-ejection nozzles 202A and 204B on the fluid-ejection printhead die 102B; that is, the mixing barrier 206A is situated between the aforementioned first and fourth rows. The mixing barrier 206A minimizes mixing of the fluid of the first type ejected by the fluid-ejection nozzles 202A with the fluid of the second type ejected by the fluid-ejection nozzles 204B during wiping of the fluid-ejection printhead die 102B.

The mixing barrier 206B is situated at a short edge 208 of the fluid-ejection printhead die 1028, substantially between the fluid-ejection nozzles 2026 (i.e., the aforementioned second row) and the fluid-ejection nozzles 204B (i.e., the aforementioned fourth row). The short edge 208 is one of two short edges of the fluid-ejection printhead die 102B, which are non-parallel to the axis 103; the printhead die 1026 also has two long edges that are parallel to the axis 103. The fluid-ejection nozzles 202B (i.e., the aforementioned second row) and the fluid-ejection nozzles 204B (i.e., the aforementioned fourth row) end at the short edge 208.

The short edge 208 of the fluid-ejection printhead die 102B abuts a corresponding short edge 210 of the fluid-ejection printhead die 102C. The short edge 210 is one of two short edges of the fluid-ejection printhead die 102C, which are non-parallel to the axis 103; the printhead die 102C also has two long edges that are parallel to the axis 103. The fluid-ejection nozzles 202C (i.e., the aforementioned fifth row) and the fluid-ejection nozzles 204C (i.e., the aforementioned sixth row) end at the short edge 210.

The mixing barrier 206B can in one embodiment be at least substantially shaped as a triangle, as is depicted in FIG. 2. The triangle has a first corner and a second corner on the short edge 208 of the fluid-ejection printhead die 102B. The triangle further has a third corner between the fluid-ejection nozzles 202B (i.e., the aforementioned second row) and the fluid-ejection nozzles 204B (i.e., the aforementioned fourth row). The mixing barrier 206B minimizes mixing of the fluid of the first type ejected by the fluid-ejection nozzles 202C of the fluid-ejection printhead die 102C with the fluid of the second type ejected by the fluid-ejection nozzles 204B of the printhead die 1026.

The mixing barrier 206C is situated at the short edge 210 of the fluid-ejection printhead die 102C, substantially between the fluid-ejection nozzles 202C (i.e., the aforementioned fifth row) and the fluid-ejection nozzles 204C (i.e., the aforementioned sixth row). The mixing barrier 206C can in one embodiment also be at least substantially shaped as a triangle, as is depicted in FIG. 2. The triangle has a first corner and a second corner on the short edge 210 of the fluid-ejection printhead die 102C. The triangle further has a third corner between the fluid-ejection nozzles 202C (i.e., the aforementioned fifth row) and the fluid-ejection nozzles 204C (i.e., the aforementioned sixth row). The mixing barrier 206C minimizes mixing of the fluid of the first type ejected by the fluid-ejection nozzles 202C of the fluid-ejection printhead die 102C with the fluid of the second type ejected by the fluid-ejection nozzles 204C of the printhead die 1026.

In this way, the mixing barriers 206 at least substantially prevent the fluid-ejection nozzles 202 and 204 from being contaminated with fluid of types that are different than the types that they eject. As such, the inventive mixing barriers 206 at least substantially overcome the problems of such contamination as has been described above. The mixing barrier 206A minimizes cross-contamination between the fluid-ejection nozzles 202A and the fluid-ejection nozzles 204B. The mixing barriers 206B and 206C minimize cross-contamination between the fluid-ejection nozzles 204B and 202C.

It is noted that the fluid-ejection printhead dies 102 are at least substantially identical to one another. For example, the fluid-ejection printhead die 102B has a left side identical to the left side of the printhead die 102C as depicted in FIG. 2, and the printhead die 102C has a right side identical to the right side of the printhead die 102B as depicted in FIG. 2. Similarly, the fluid-ejection printhead dies 102A and 102D of FIG. 1 each can have a left side identical to the left side of the die 102C as depicted in FIG. 2 and a right side identical to the right side of the die 102B as depicted in FIG. 2.

It is further noted that the mixing barriers 206 have been described are exemplarily representative of mixing barriers as to the nozzles to either side of the dotted lines 106B and 106C, and of mixing barriers as to the nozzles to either side of the dotted lines 106C and 106D. The corresponding mixing barriers as to the fluid-ejection nozzles to either side of the dotted lines 106B and 106C inhibit fluids of the second and the third types from mixing. The corresponding mixing barriers as to the fluid-ejection nozzles to either side of the dotted lines 106C and 1060 inhibit fluids of the third and the fourth types from mixing.

Additional Embodiment

Figure 3:
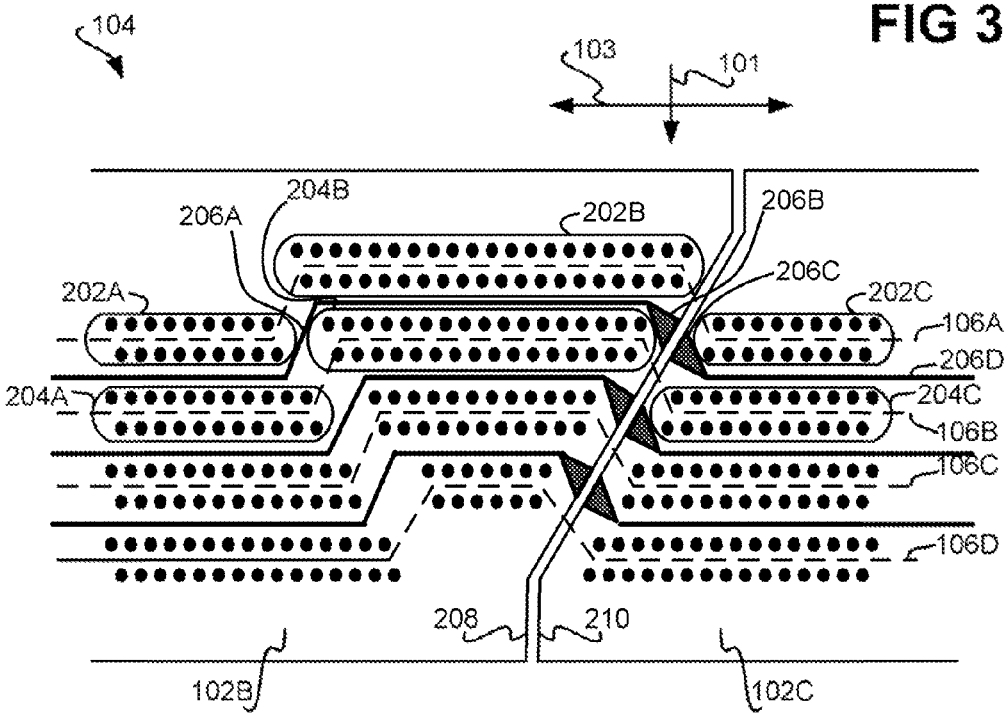
FIG. 3 is a diagram of a portion of a fluid-ejection device having mixing barriers on its fluid-ejection printhead dies, according to another embodiment of the present disclosure.

FIG. 3 shows the blown-up or zoomed-in region 104 of the fluid-ejection device 100 of FIG. 1 in detail, in relation to which the solution to the problem that has been described above is described in detail, according to another embodiment of the disclosure. The fluid-ejection nozzles of the fluid-ejection printhead dies 102B and 102C are depicted, organized to either side of the four dotted lines 106A, 106B, 106C, and 106D. The solution is exemplarily described in relation to the fluid-ejection nozzles to either side of the dotted lines 106A and 106B. However, the solution is equally appropriate in relation to the fluid-ejection nozzles to either side of the dotted lines 106C and 106D as well. Like-numbered elements of FIG. 3 as compared to FIG. 2 operate at least substantially identically in FIG. 3 as compared to in FIG. 2, and the description of these components are not presented in this section of the detailed description to avoid redundancy.

The difference between the embodiment of FIG. 3 and the embodiment of FIG. 2 is two-fold. First, the mixing barrier 206A extends on the fluid-ejection printhead die 1026 to the left between the fluid-ejection nozzles 202A (i.e., the aforementioned first row) and the nozzles 204A (i.e., the aforementioned third row), as well as to the right between the nozzles 202B (i.e., the aforementioned second row) and the nozzles 204B (i.e., the aforementioned fourth row). Second, the fluid-ejection printhead die 102C also includes a mixing barrier 206D, which is one of the mixing barriers 206 in the embodiment of FIG. 3, between the fluid-ejection nozzles 202C (i.e., the aforementioned fifth row) and the nozzles 204C (i.e., the aforementioned sixth row).

As to the extension of the mixing barrier 206A between the fluid-ejection nozzles 202A and 204A and between the fluid-ejection nozzles 202B and 2046, this extension further minimizes the potential for the mixing of fluids of different types, particularly during wiping. For example, if wiping were to be achieved across the fluid-ejection printhead dies 102 back and forth parallel to the media movement direction 101, then the extension of the mixing barrier 206A inhibits the fluid of the first type from mixing with the fluid of the second type. Specifically, the extension of the mixing barrier 206A inhibits the fluid-ejection nozzles 202A from becoming contaminated by the fluid of the second type ejected by the nozzles 204A, and inhibits the nozzles 204A from being contaminated by the fluid of the first type ejected by the nozzles 202A. Likewise, the extension of the mixing barrier 206A inhibits the fluid-ejection nozzles 202B from being contaminated by the fluid of the second type ejected by the nozzles 2046, and inhibits the nozzles 204B from being contaminated by the fluid of the first type ejected by the nozzles 204A.

As to the mixing barrier 206D between the fluid-ejection nozzles 202C and 204C, this extension also further minimizes the potential for the mixing of fluids of different types, particularly during wiping. For example, if wiping were to be achieved across the fluid-ejection printhead dies 102 back and forth parallel to the media movement direction 101, then the mixing barrier 206D inhibits the fluid of the first type from mixing with the fluid of the second type. Specifically, the mixing barrier 206D inhibits the fluid-ejection nozzles 202C from being contaminated by the fluid of the second type ejected by the nozzles 204C, and inhibits the nozzles 204C from being contaminated by the fluid of the first type ejected by the nozzles 202C.

As has been noted above, the right side of the fluid-ejection printhead die 102C can be identical to the right side of the printhead die 102B. In such instances, the mixing barrier 206D is actually an extension of another mixing barrier on the fluid-ejection printhead die 102C. Specifically, the mixing barrier 206D is the extension of the mixing barrier on the fluid-ejection printhead die 102C that is equivalent to the extension of the mixing barrier 206A on the printhead die 102B. As has been also noted above, the left side of the fluid-ejection printhead die 102B can be identical to the left side of the printhead die 102C. In such instances, the extension of the mixing barrier 206A on the fluid-ejection printhead die 102B includes the equivalent of the mixing barrier 206D on the printhead die 102C.

Types of Mixing Barriers

Figure 4A:
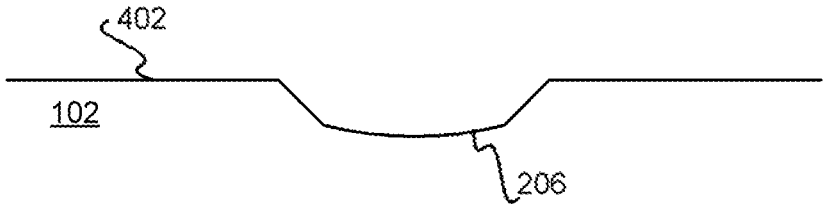
FIGS. 4A and 4B are diagrams of two different representative types of mixing barriers, according to varying embodiments of the present disclosure.
Figure 4B:
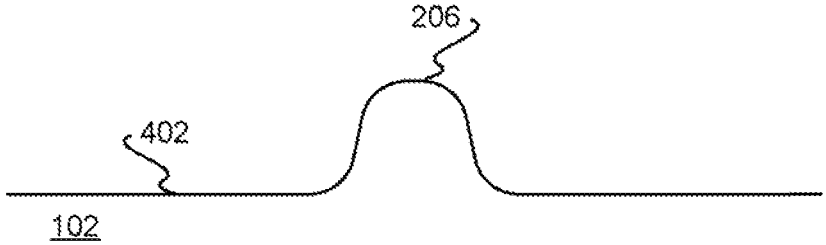

FIGS. 4A and 4B show two types of mixing barriers 206, according to different embodiments of the disclosure. Both FIGS. 4A and 4B are cross-sectional views of a portion of an exemplary fluid-ejection printhead die 102. The fluid-ejection printhead die 102 includes a surface 402, which is the surface that is depicted in the blown-up or zoomed-in region 104 of the fluid-ejection device of FIGS. 1, 2, and 3. It is noted that the mixing barriers 206 can in one embodiment serve as the means by which fluid of a given type ejected by a given row of fluid-ejection nozzles is minimized from mixing with fluid of another type ejected by another given row of fluid-ejection nozzles, at least during wiping of the fluid-ejection printhead die 102.

In FIG. 4A, the mixing barrier 206 is depicted as an exemplary first type, which is specifically a shallow groove within the surface 402 of the fluid-ejection printhead die 102. In FIG. 4B, the mixing barrier 206 is depicted as an exemplary second type, which is specifically a protrusion extending from the surface 402 of the fluid-ejection printhead die 102. The mixing barriers 206 of FIGS. 2 and 3 on a given fluid-ejection printhead die 102 or on different printhead dies 102 can each be one of these two types of mixing barriers, among other types of mixing barriers.

The shallow groove mixing barrier 206 in FIG. 4A acts as a channel into which fluid can be wiped during wiping of the fluid-ejection printhead die 102 to inhibit cross-contamination of the fluid-ejection nozzles of the printhead die 102. The shallow groove further may attract such fluid via capillary wicking action. The protrusion mixing barrier 206 in FIG. 4B acts as a wall past which fluid that is wiped during wiping of the fluid-ejection printhead die 102 cannot travel, also to inhibit cross-contamination of the fluid-ejection nozzles of the printhead die 102.

Representative Operation of Fluid-ejection Device

Figure 5:
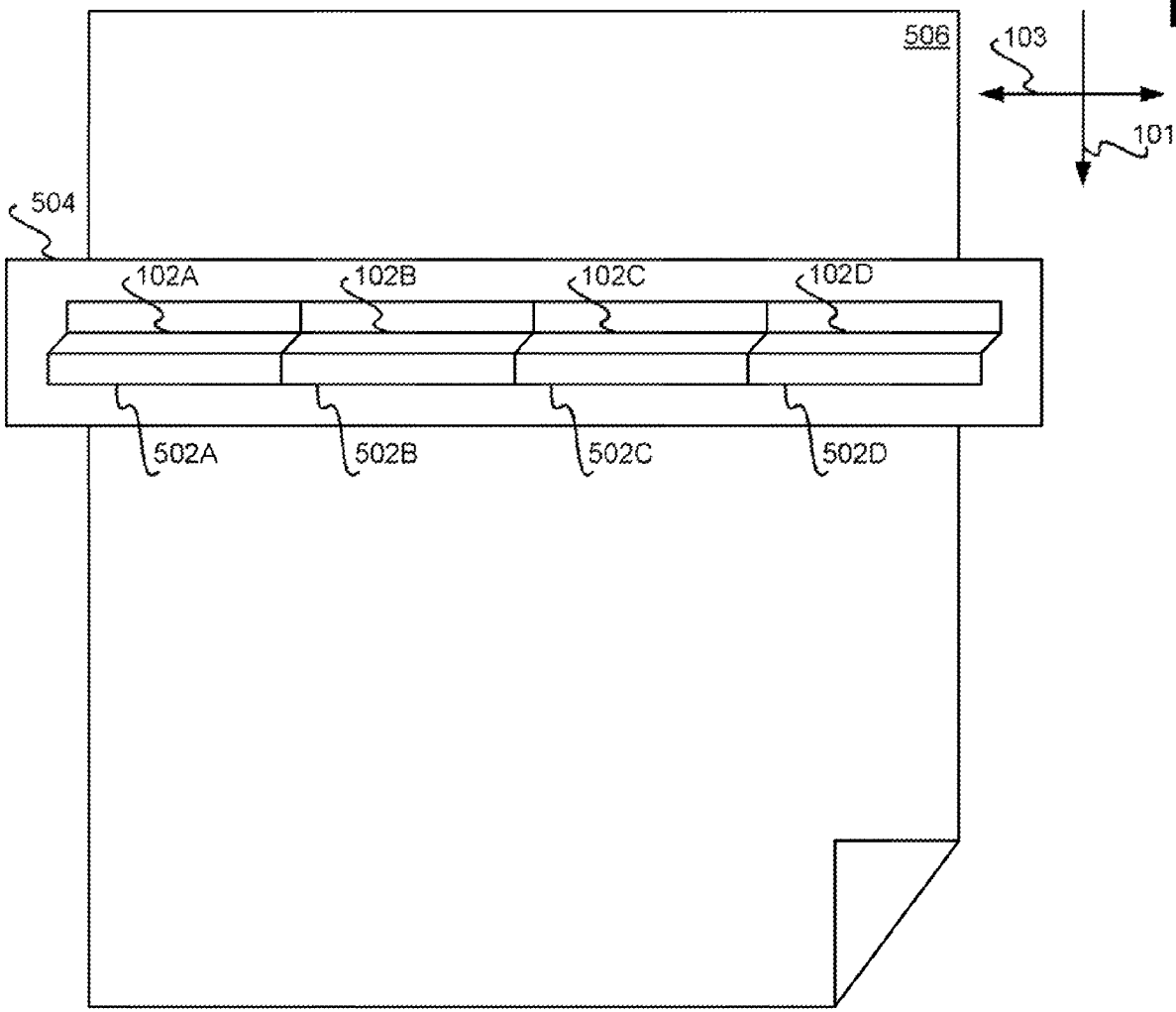
FIG. 5 is a diagram depicting operation of a representative fluid-ejection device, according to an embodiment of the present disclosure.

FIG. 5 shows representative operation of the fluid-ejection device 100, according to an embodiment of the disclosure in which the device 100 is a page-wide array fluid-ejection device. The fluid-ejection device 100 may be an inkjet-printing device, which is a device, such as a printer, that ejects ink onto media sheets, such as paper, to form images, which can include text, on the media sheets. The fluid-ejection device 100 of all embodiments of the present disclosure is most generally a fluid-ejection precision-dispensing device that precisely dispenses fluid, such as ink. The fluid-ejection device 100 may eject pigment-based ink, dye-based ink, another type of ink, or another type of fluid. Embodiments of the present disclosure can thus pertain to any type of fluid-ejection precision-dispensing device that dispenses a substantially liquid fluid.

A fluid-ejection precision-dispensing device is therefore a drop-on-demand device in which printing, or dispensing, of the substantially liquid fluid in question is achieved by precisely printing or dispensing in accurately specified locations, with or without making a particular image on that which is being printed or dispensed on. As such, a fluid-ejection precision-dispensing device is in comparison to a continuous precision-dispensing device, in which a substantially liquid fluid is continuously dispensed therefrom. An example of a continuous precision-dispensing device is a continuous inkjet-printing device.

The fluid-ejection precision-dispensing device precisely prints or dispenses a substantially liquid fluid in that the latter is not substantially or primarily composed of gases such as air. Examples of such substantially liquid fluids include inks in the case of inkjet-printing devices. Other examples of substantially liquid fluids include drugs, cellular products, organisms, fuel, and so on, which are not substantially or primarily composed of gases such as air and other types of gases, as can be appreciated by those of ordinary skill within the art.

The fluid-ejection printhead dies 102 are part of corresponding fluid-ejection printheads 502A, 502B, 502C, and 502D, collectively referred to as the fluid-ejection printheads 502. Where the fluid-ejection device 100 is an inkjet-printing device, the fluid-ejection printheads 502 are inkjet printheads, and the fluid-ejection printhead dies 102 are inkjet printhead dies. The fluid-ejection printheads 502 are themselves mounted on a print bar, or frame, 504 that nominally extends over the entire width of a media sheet 506. The fluid-ejection device 100 can and typically does include other components, in addition to and/or in lieu of those depicted in FIG. 5, such as fluid supplies, tubing, power supplies, and so on.

The fluid-ejection device 100 in the embodiment of FIG. 5 is specifically a page-wide array fluid-ejection device, as opposed to a scanning printhead fluid-ejection device like a scanning printhead inkjet-printing device as has been described above. The fluid-ejection printheads 502 are positioned on the print bar 504 so that the entire width of the media sheet 506 is covered by the fluid-ejection printhead dies 102. In normal operation of the fluid-ejection device 100, fluid such as ink is supplied to the fluid-ejection printheads 502. The fluid-ejection nozzles of the fluid-ejection printhead dies 102 selectively eject fluid drops onto the media sheet 506 as the media sheet 506 moves past the print bar 504 in the direction 101 that is perpendicular to the axis 103 of the print bar 504.

In this way, therefore, an image may be printed on the media sheet 506 using ink ejected by the fluid-ejection printhead dies 102 of the fluid-ejection printheads 502. As such, typically the print bar 504, and thus the fluid-ejection printheads 502 and their printhead dies 102, remain stationary during fluid ejection by the fluid-ejection device 100. In this respect, the page-wide array fluid-ejection device 100 in the embodiment of FIG. 5 is also distinguished from a scanning printhead fluid-ejection device, in which a printhead is moved, or scanned, during fluid ejection by the device.

We claim:

1. A fluid-ejection printhead die comprising:

a plurality of first fluid-ejection nozzles to eject fluid of a first type, the first fluid-ejection nozzles organized over a first row and a second row non-collinear to the first row;

a plurality of second fluid-ejection nozzles to eject fluid of a second type different than the first type, the second fluid-ejection nozzles organized over a third row and a fourth row non-collinear to the third row, the fourth row at least substantially collinear to the first row; and, a mixing barrier at least substantially between the first row of the first fluid-ejection nozzles and the fourth row of the second fluid-ejection nozzles;

wherein the first row and the fourth row each have a short edge and a long edge, and the mixing barrier is positioned just between the short edge of the first row and the short edge of the fourth row; or wherein the first row and the fourth row each have a short edge and a long edge, and the mixing barrier is positioned both between the short edge of the first row and the short edge of the fourth row and between the long edge of the first row and the long edge of the fourth row.

2. The fluid-ejection printhead die of claim 1, wherein the mixing barrier is to minimize mixing of the fluid of the first type with the fluid of the second type at least during wiping of the fluid-ejection printhead die.

3. The fluid-ejection printhead die of claim 1, wherein the mixing barrier comprises a groove within a surface of the fluid-ejection printhead die.

4. The fluid-ejection printhead die of claim 1, wherein the mixing barrier comprises a protrusion extending from a surface of the fluid-ejection printhead die.

5. The fluid-ejection printhead die of claim 1, wherein the mixing barrier is a first mixing barrier, the first row is longer than the second row, the third row is longer than the fourth row, and the fluid-ejection printhead die further comprises:

a short edge to abut a corresponding short edge of another fluid-ejection printhead die, the second row of the first fluid-ejection nozzles and the fourth row of the second fluid-ejection nozzles ending at the short edge; and, a second mixing barrier at the short edge and substantially between the second row of the first fluid-ejection nozzles and the fourth row of the second fluid-ejection nozzles.

6. The fluid-ejection printhead die of claim 5, wherein the second mixing barrier is at least substantially shaped as a triangle having a first corner and a second corner on the short edge, the triangle having a third corner between the second row of the first fluid-ejection nozzles and the fourth row of the second fluid-ejection nozzles.

7. The fluid-ejection printhead die of claim 1, wherein the mixing barrier is a first mixing barrier, the first row is longer than the second row, the third row is longer than the fourth row, and the fluid-ejection printhead die further comprises:

a short edge to abut a corresponding short edge of another fluid-ejection printhead die, the first row of the first fluid-ejection nozzles and the third row of the second fluid-ejection nozzles ending at the short edge; and, a second mixing barrier at the short edge and substantially between the first row of the first fluid-ejection nozzles and the third row of the second fluid-ejection nozzles.

8. The fluid-ejection printhead die of claim 7, wherein the second mixing barrier is at least substantially shaped as a triangle having a first corner and a second corner on the short edge, the triangle having a third corner between the first row of the first fluid-ejection nozzles and the third row of the second fluid-ejection nozzles.

9. The fluid-ejection printhead die of claim 1, wherein the mixing barrier further extends between one or more of:

the first row of the first fluid-ejection nozzles and the third row of the second fluid-ejection nozzles;

the second row of the first fluid-ejection nozzles and the fourth row of the second fluid-ejection nozzles.

10. The fluid-ejection printhead die of claim 1, wherein the fluid-ejection printhead die is an inkjet-printing device printhead die, the fluid of the first type is ink of a first color, and the fluid of the second type is ink of a second color different than the first color.

11. A fluid-ejection device comprising:

a first fluid-ejection printhead die having a short edge; and, a second fluid-ejection printhead die having a short edge abutting the short edge of the first fluid-ejection printhead die, wherein each of the first and the second fluid-ejection printhead dies comprises:

a plurality of first fluid-ejection nozzles to eject fluid of a first type, the first fluid-ejection nozzles organized over a first row and a second row non-collinear to the first row;

a plurality of second fluid-ejection nozzles to eject fluid of a second type different than the first type, the second fluid-ejection nozzles organized over a third row and a fourth row non-collinear to the third row, the fourth row at least substantially collinear to the first row; and, a mixing barrier at least substantially between the first row of the first fluid-ejection nozzles and the fourth row of the second fluid-ejection nozzles;

wherein the first row and the fourth row each have a short edge and a long edge, and the mixing barrier is positioned just between the short edge of the first row and the short edge of the fourth row; or wherein the first row and the fourth row each have a short edge and a long edge, and the mixing barrier is positioned both between the short edge of the first row and the short edge of the fourth row and between the long edge of the first row and the long edge of the fourth row.

12. The fluid-ejection device of claim 11, wherein the mixing barrier of the first fluid-ejection printhead die is a first mixing barrier, and the mixing barrier of the second fluid-ejection printhead die is a second mixing barrier, wherein the first row of the first fluid-ejection printhead die is longer than the second row of the first fluid-ejection printhead die, the third row of the first fluid-ejection printhead die is longer than the fourth row of the first fluid-ejection printhead die, wherein the first row of the second fluid-ejection printhead die is longer than the second row of the second fluid-ejection printhead die, the third row of the second fluid-ejection printhead die is longer than the fourth row of the second fluid-ejection printhead die, and wherein the first fluid-ejection printhead die further comprises:

a third mixing barrier at the short edge of the first fluid-ejection printhead die and substantially between the second row of the first fluid-ejection nozzles of the first fluid-ejection printhead die and the fourth row of the first fluid-ejection nozzles of the first fluid-ejection printhead die.

13. The fluid-ejection device of claim 12, wherein the second fluid-ejection printhead die further comprises:

a fourth mixing barrier at the short edge of the second fluid-ejection printhead die and substantially between the first row of the first fluid-ejection nozzles of the second fluid-ejection printhead die and the third row of the second fluid-ejection nozzles of the second fluid-ejection printhead die.

14. The fluid-ejection device of claim 11, wherein the fluid-ejection device is an inkjet-printing device, the fluid of the first type is ink of a first color, and the fluid of the second type is ink of a second color different than the first color.

15. A fluid-ejection printhead die comprising:

a plurality of first fluid-ejection nozzles to eject fluid of a first type, the first fluid-ejection nozzles organized over a first row and a second row non-collinear to the first row;

a plurality of second fluid-ejection nozzles to eject fluid of a second type different than the first type, the second fluid-ejection nozzles organized over a third row and a fourth row non-collinear to the third row, the fourth row at least substantially collinear to the first row; and, means for minimizing, at least during wiping of the fluid-ejection printhead die, the fluid of the first type ejected by at least the first row of the first fluid-ejection nozzles from mixing with the fluid of the second type ejected by at least the fourth row of the second fluid-ejection nozzles;

wherein the first row and the fourth row each have a short edge and a long edge, and the means is positioned just between the short edge of the first row and the short edge of the fourth row; or wherein the first row and the fourth row each have a short edge and a long edge, and the means is positioned both between the short edge of the first row and the short edge of the fourth row and between the long edge of the first row and the long edge of the fourth row.

16. The fluid-ejection printhead die of claim 1, wherein the mixing barrier is at least substantially shaped as a triangle.

17. The fluid-ejection printhead die of claim 1, wherein the mixing barrier comprises a linear portion and an at least substantially triangle-shaped portion connected to the linear portion.

18. The fluid-ejection printhead die of claim 1, wherein the first row and the fourth row each have a short edge and a long edge, and the mixing barrier is positioned just between the short edge of the first row and the short edge of the fourth row.

19. The fluid-ejection printhead die of claim 1, wherein the first row and the fourth row each have a short edge and a long edge, and the mixing barrier is positioned both between the short edge of the first row and the short edge of the fourth row and between the long edge of the first row and the long edge of the fourth row.

* * * * *